US005320546A

United States Patent [19]

Weber

[11] Patent Number: 5,320,546

[45] Date of Patent: Jun. 14, 1994

[54] ELECTRICAL CONNECTOR WITH INTERLOCKED COMPONENTS

[75] Inventor: Ronald M. Weber, Lebanon, Pa.

[73] Assignee: The Whitaker Corporation, Wilmington, Del.

[21] Appl. No.: 36,125

[22] Filed: Mar. 22, 1993

Related U.S. Application Data

[63] Continuation of Ser. No. 864,865, Apr. 7, 1992, abandoned, which is a continuation-in-part of Ser. No. 686,908, Apr. 16, 1991, Pat. No. 5,108,300.

[51] Int. Cl.[5] ..... H01R 33/96

[52] U.S. Cl. ..... 439/188; 200/51.1

[58] Field of Search ..... 439/188, 607, 609, 610, 439/620, 581, 903; 333/181-185; 200/51.1

[56] References Cited

U.S. PATENT DOCUMENTS

| | | | |
|---|---|---|---|
| 3,536,870 | 10/1970 | Izumi | 200/51.1 |
| 4,361,376 | 11/1982 | Gallusser et al. | 439/598 |
| 4,633,048 | 12/1986 | Komatsu | 200/51.1 |
| 4,659,162 | 4/1987 | Cartesse | 339/128 |
| 4,666,231 | 5/1987 | Sheesley et al. | 339/177 |
| 4,722,022 | 1/1988 | Myers et al. | 361/424 |
| 4,804,339 | 2/1989 | Cohen | 439/588 |
| 4,846,719 | 7/1989 | Iwashita | 439/63 |
| 4,884,982 | 12/1989 | Fleming et al. | 439/620 |
| 4,906,208 | 3/1990 | Nakamura et al. | 439/607 |
| 5,030,122 | 7/1991 | Birch et al. | 439/188 |
| 5,073,123 | 12/1991 | Birch et al. | 439/188 |
| 5,076,797 | 12/1991 | Moulton | 439/188 |
| 5,108,300 | 4/1992 | Weber | 439/188 |

*Primary Examiner*—Neil Abrams

[57] ABSTRACT

An electrical connector includes a conductive shell with electrical terminals, an insulator, conductive switch contacts, and an electrical circuit element constructed to engage the shell and the switch contact. The shell and the insulator interlock for ease of assembly.

7 Claims, 2 Drawing Sheets

ELECTRICAL CONNECTOR WITH INTERLOCKED COMPONENTS

This application is a continuation of U.S. patent application, Ser. No. 07/864,865 filed Apr. 7, 1992, now abandoned, which in turn is a continuation-in-part of U.S. patent application, Ser. No. 07/686,908 filed Apr. 16, 1991, now U.S. Pat. No. 5,108,300.

FIELD OF THE INVENTION

The invention relates to an electrical connector useful for interconnecting with a mating connector for coaxial cable, and particularly, component parts of such a connector, which interlock for ease of assembly. In particular the invention relates to a unique connector for coaxial cable having an insulator and conducting shell which interlock with each other.

Furthermore, the invention relates to a unique electrical contact used in an electrical connector having a switch contact with a preloaded spring force to assure sufficient contact pressure against a pin of a complementary connector which is inserted in the connector.

BACKGROUND OF THE INVENTION

A connector is known from U.S. Pat. No. 4,884,982 and comprises electrical capacitor elements inset within an outer profile of the connector and a conductive clip holding the capacitor elements in pressure contact with a conductive shell of the connector. This known connector includes an electrical contact with an electrical receptacle portion within the shell of the connector.

Another known connector, disclosed in U.S. application Ser. No. 07/519,968, filed May 7, 1990, now U.S. Pat. No. 5,030,122 comprises electrical switch contacts within a conductive shell of the connector.

In the known connectors described above, the component parts are not interlocked. Consequently, a manufacturing operation is required to fix in place the component parts. For the connector known from U.S. Pat. No. 4,884,982, a thin flange is flared outwardly. For the connector known from the '968 U.S. patent application, the shell is built from bipartite sections.

Other examples of known electrical connectors are illustrated in U.S. Pat. Nos. 5,073,123 and 5,030,122 by Birch et al. wherein each patent discloses a bipartite dielectric support surrounded by conductive shells of two electrical connectors. The dielectric support receives first and second switch contacts. The first switch contact has a curved contact while the second switch contact is straight.

U.S. Pat. No. 4,906,208 by Nakamura et al. discloses an electrical connector comprising a shielding shell and an insulating housing with female contacts. The insulating housing has latch bosses to be received by latch apertures located on the shielding shell so that the insulating housing and shielding shell are locked.

Another patent disclosing a contact element is U.S. Pat. No. 4,804,339 by Cohen which discloses an insulative body assembled in a conductive shell, two pairs of contacts located inside of the insulative body, and each pair of contacts comprises a straight contact and a curved contact which engage each other until the connector assemblies are mated together.

Various alternative connecting schemes between a conductor and insulator are disclosed in U.S. Pat. Nos. 4,722,022, 4,666,231, and 4,659,162. U.S. Pat. No. 4,722,022 by Myers et al. discloses an outer insulative enclosure and conductive shields enclosing a line terminator. The conductive shields have gripping means which engage the side walls of the outer insulative enclosure to enhance the friction fit.

U.S. Pat. No. 4,666,231 by Sheesley et al. discloses a shell assembled in a front end of an insulative body.

U.S. Pat. No. 4,659,162 by Cartesse discloses a connector casing which receives insulating blocks which have receiving sockets. Clips are used to lock the blocks into the casing.

It is an object of the present invention to provide an improved interlocking structure between an insulator and a conducting shell of a connector to provide for ease of manufacture and assembly.

Another object of the present invention is to provide an improved contact device of a connector with a preloaded spring force to assure there is sufficient contact pressure against a pin of a complementary connector which is inserted in the connector. Thus, the contact device does not require a large deflection by the inserted pin to produce the desired contact pressure.

Another object of the present invention is to provide a contact device with lower frictional resistance against initial engagement during insertion of a pin of a complementary connector.

A further object of the present invention is to provide an improved contact device which resists stubbing with a pin of a complementary connector.

These and other objects and advantages of the present invention will be apparent to those skilled in the art after a consideration of the following detailed description, taken in conjunction with the accompanying drawings in which a preferred form of the present invention is illustrated.

SUMMARY OF THE INVENTION

According to a first aspect of the present invention, an electrical connector comprises component parts including an electrical contact device within a conductive shell, and wherein the component parts of the connector are constructed with interlocking features that permit the component parts to interlock with one another. Manufacture of the connector is simplified by having the parts constructed so as to interlock with one another.

According to a second aspect of the present invention, an electrical connector comprises a conductive shell, an electrical contact device held by an insulator in the shell, a circuit element received in a recess in the insulator engaging said electrical contact device, the circuit element and the insulator being slidable together along a cavity communicating with an end of the shell, and the insulator being constructed with latches for limiting relative movement of the insulator and the shell.

According to a third aspect of the present invention, an electrical contact comprises a first switch contact and a second switch contact, wherein the first switch contact comprises a biasing element and a deflection portion. The biasing element provides a closed switch between the first switch contact and the second switch contact. The deflection portion is located separate from said biasing element and provides for contact with a pin of a complementary connector.

According to a fourth aspect of the present invention, a connector comprises a biasing element having a switch contact which is offset from the axis of insertion of a pin of a complementary connector to prevent stubbing of the pin during insertion. The offset switch contact assures that there is lowered frictional resistance of the end of the biased contact against initial engagement with the pin during insertion.

For an understanding of the invention, reference will now be made, by way of example, to a description of an embodiment of the invention taken in conjunction with accompanying drawings.

DETAILED DESCRIPTION

Figure 1:
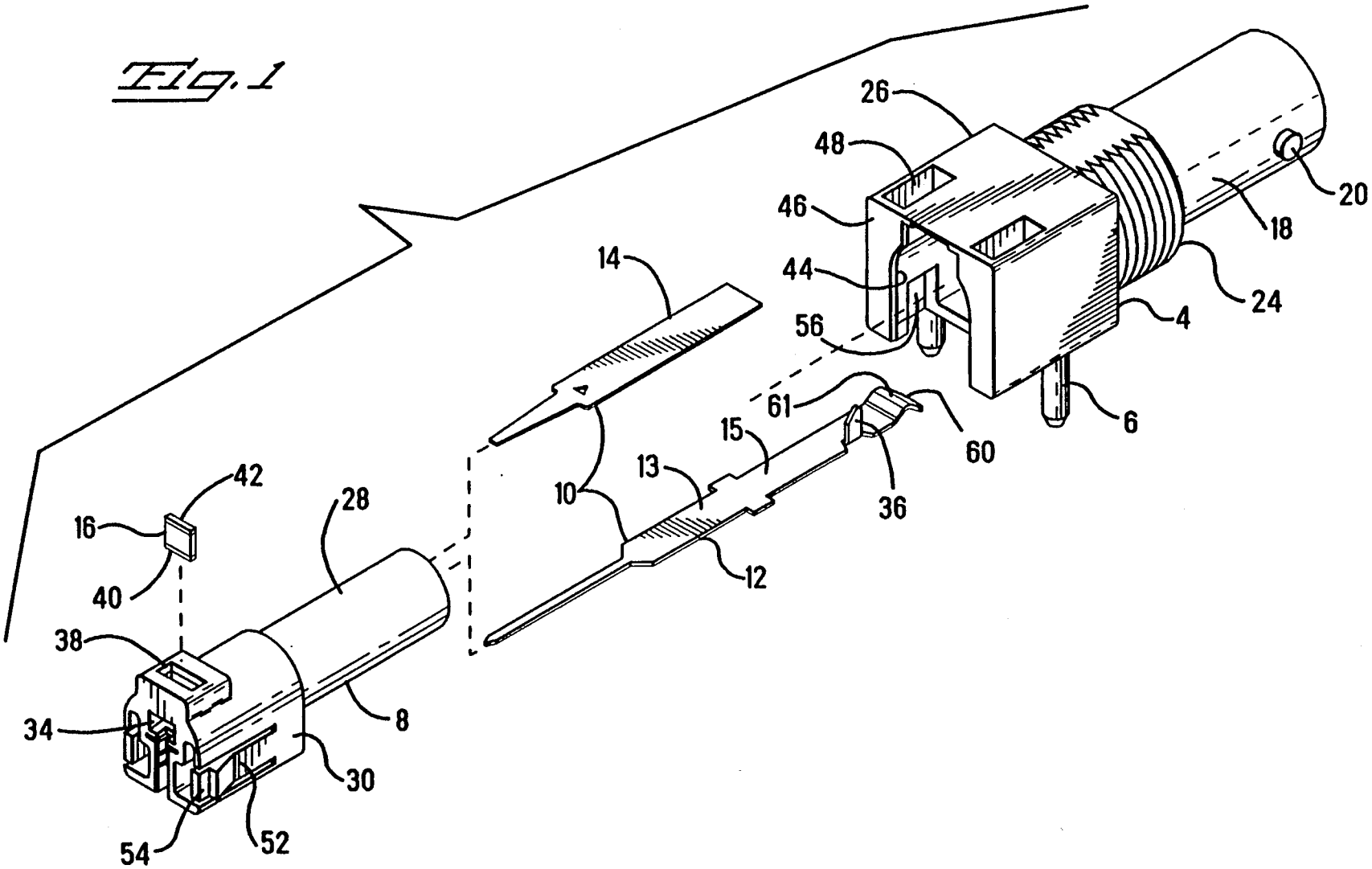
FIG. 1 is a perspective view of a connector with parts separated from one another.
Figure 2:
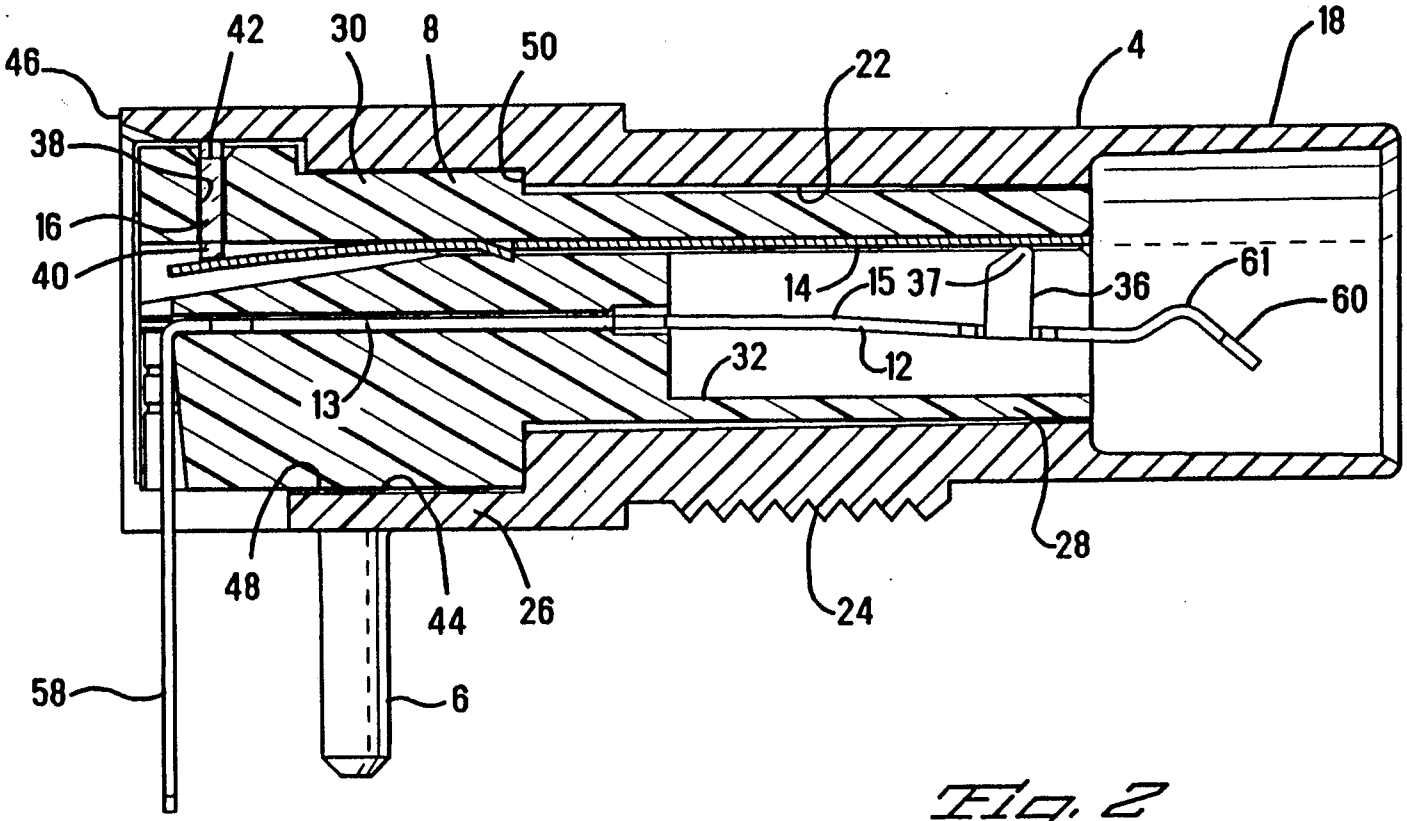
FIG. 2 is a longitudinal section view of the connector of FIG. 1.

With reference to FIGS. 1 and 2 of the drawings, an electrical connector 2 comprises a conductive shell 4 having electrical terminals 6, an insulator 8, and contact means 10, for example, in the form of conductive switch contacts 12, 14. The connector 2 provides an electrical pathway connecting a complementary connector (not shown) with a conductive panel such as a printed circuit board (not shown). As shown in FIG. 2, when no complementary connector is present switch contacts 12 and 14 form a closed circuit with an electrical circuit element 16. Once a pin of a complementary connector is inserted in the connector 2 the pin engages a front end 60 of switch contact 12 and separates switch contacts 12 and 14 from each other. Thus, electrical contact is established between the electrical element associated with the complementary connector, such as a coaxial cable, and the conductive panel via switch contact 12 and terminal 58 which is electrically connected to the conductive panel.

Conductive switch contacts 12, 14 are made of a conductive material, preferably phosphor bronze. The contact means 10 can comprise other forms, for example, an electrical receptacle as disclosed in U.S. Pat. No. 4,884,982 or the conductive switch contacts disclosed in U.S. patent application Ser. No. 07/686,908, U.S. Pat. No. 5,108,300 whose disclosure is incorporated herein by reference. As shown in FIG. 1, an electrical circuit element 16 is constructed to engage the shell 4 and the switch contact 14. The shell 4 and the insulator 8 are constructed to interlock for ease of assembly.

With reference to FIGS. 1 and 2, the shell 4 is of unitary construction, and has a forward, hollow cylindrical portion 18 having a reduced perimeter profile provided with terminals such as bayonet coupling prongs 20 one of which is shown in FIG. 1 for connection with a mating electrical connector, not shown, in a manner disclosed in the U.S. patent application Ser. No. 07/519,968, U.S. Pat. No. 5,030,322 identified above. Shell 4 is made of a conductive material, preferably zinc. The terminals 6 and 20 are formed integrally with the shell 4. The shell 4 further includes a stepped passage 22 having external threads 24 and a relatively enlarged, hollow noncylindrical portion 26. A threaded nut (not shown) engages external threads 24 to secure the shell 4 to a panel (not shown).

The insulator 8 is preferably of unitary construction and includes a front cylindrical portion 28 and a relatively enlarged noncylindrical portion 30. Insulator 8 is made of a dielectric material, such as a polyester based material known as PBT, preferably a material known by the tradename Valox DR48. A first contact receiving cavity 32 receives the switch contact 12 therein. The first contact receiving cavity 32 receives the second switch contact 14 which extends into a second contact receiving cavity 34. The first switch contact 12 includes a shank portion 13 which defines a plane and is held within the insulator 8, and a beam portion 15 which extends through the cavity 32 and terminates in a curved front end, or contact end, 60 which is outside of the insulator 8 but within the shell 4. The curved front end 60 has an upwardly bent portion and a downwardly bent portion joined by an apex 61.

The first switch contact 12, having a biasing element such as finger 36, is resiliently biased in engagement against the second switch contact 14. In a preferred embodiment the finger 36 is oriented perpendicular to a plane defined by contact 12 and is separate from the curved front end 60 which engages a pin of a complementary connector. The finger 36 has a trapezoidal shape where the top corners of the trapezoid are preferably rounded as shown in FIGS. 1 and 2. The finger 36 is oriented perpendicular to the plane defined by the first switch contact 12. A contact portion 37 of the finger 36 engages with contact 14 when there is no pin of a complementary connector present in electrical connector 2. The contact portion 37 is preferably located 0.071" above the plane of the contact 12. The height of the contact portion 37 is chosen to displace the contact 12 from a horizontal rest position and thus produces a preloaded spring effect. By supplying a preloaded spring effect, the contact pressure supplied to a pin inserted in the connector is higher than without the preloaded spring effect. Thus, contact 12 does not require large deflection by an inserted pin to provide a desired contact pressure. Though the finger 36 described herein is trapezoidally shaped it is contemplated that other shapes of the finger 36 are possible as long as they have a contact portion 37 capable of producing the desired preloaded spring effect.

Furthermore, the finger 36 is offset from the axis of insertion of a pin of a complementary connector (not shown), to assure that there is lowered frictional resistance of the end of the biased contact against initial engagement with the pin during insertion. Consequently, when a pin of a complementary connector is inserted into electrical connector 2 the pin will only engage a deflection portion of contact 12 such as front end 60. By having the finger 36 offset, the pin will not be stubbed by the finger 36 during insertion.

The electrical circuit element 16, for example, a resistor, is held in a recess 38 in a side of the insulator 8. Electrical circuit element 16 may consist of either a wire bound resistor, a carbon-based resistor, a thin film chip resistor, or a thick film chip resistor. The value of the resistance of electrical circuit element 16 would be dependent on the intended use for the electrical connector 2. One conductive surface 40 of the circuit element 16 engages the second switch element 14. A second conductive surface 42 of the circuit element 16 faces toward an open side of the recess 38.

The shell 4 is received over the preassembled, combination of the insulator 8, contacts 12, 14 and circuit element 16. A passage 44 of the shell 4 has a stepped interior communicating with a rear end 46 of the shell 4 and slidably receives the insulator 8. The second conductive surface 42 of the circuit element 16 is slidable together with the insulator 8 along the passage 44. The interior of the shell 4 drives the circuit element 16 deeper into the recess 38. The switch contact 14 is deflected by the circuit element 16. In turn, the switch contact 14 resiliently biases the circuit element 16 in contact against the interior of the shell 4.

The noncylindrical portion 30 of the insulator 8 is received by a conforming noncylindrical portion 48 of the passage 44 of the shell 4 to prevent relative rotation of the insulator 8 and the shell 4. A front of the noncylindrical portion 30 of the insulator 8 engages a rear facing shoulder 50 of the passage 44. The insulator 8 is provided with resilient latch fingers 52 with forward tapered wedges and rear facing shoulders 54. In an engaged state the latch fingers 52 are biased inward by the interior of the shell 4 and register in recesses 56 in the interior of the shell to resist withdrawal of the insulator 8 from the shell 4. The insulator 8 is moved relative to the shell 4 when the latch fingers 52 are removed from the recesses 56 to produce a disengaged state. With reference to FIG. 2, the switch contact 12 has an electrical terminal 58 that projects from the insulator 8. The terminal 58 can be bent to extend in the same direction as the terminals 6 for connection with a printed circuit board, not shown.

With reference to FIG. 2, a front end 60 of the switch contact 12 extends toward a front of the connector 2, and is constructed for resilient spring deflection away from the switch contact 14, when the connector 2 is connected with a complementary connector, not shown, as described in the U.S. application Ser. No. 07/519,968, now U.S. Pat. No. 5,030,122, referred to above. An electrical circuit comprising the switch contacts 12, 14, the circuit element 16 and the shell 4 is interrupted when the switch contacts 12, 14 disengage from each other. When the connector 2 is disconnected from a complementary connector, not shown, the connector 2 is self-terminating, such that the switch contacts 12, 14 engage to complete the electrical circuit and provide an electrical load via the circuit element 16 instead of an open circuit condition at the contacts 12, 14.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

I claim:

1. An electrical connector for mating with a complementary coaxial cable connector comprising:

(1) a conductive shell of unitary construction having a first end that is cylindrical in shape, a second end, and a passage in communication with said first and second ends thereof;

(2) an insulator disposed within said passage of said shell and having a contact receiving cavity; and (3) a contact device comprising first and second, essentially planar, switch contacts, said first switch contact having a shank portion held within said insulator adjacent said second end, said shank defining a plane, and a beam portion within said contact receiving cavity and extending toward said first end and terminating in a contact end for electrical contact with a pin of said mating connector, said beam portion, exclusive of said contact end, being urged into alignment with said plane;

wherein said contact end of said beam portion includes an upwardly bent portion and a downwardly bent portion joined at an apex, said apex being outside of said insulator but within said passage of said shell for engagement with the pin, and said beam portion, along a mid position thereof includes an upstanding biasing element for electrical contact with said second switch contact during a period of non-mating with said mating connector.

2. The connector according to claim 2 wherein said contact receiving cavity extends toward said first end of said shell, said beam portion of said contact device extending through said contact receiving cavity with clearance.

3. The connector according to claim 2 wherein said biasing element is a contact finger that is perpendicular to said plane.

4. The connector according to claim 3 wherein said plane includes the axis in which said pin of said mating connector is to be inserted in said electrical connector, and wherein said contact finger is not aligned with said axis so that said pin remains spaced therefrom.

5. The connector according to claim 1 wherein said biasing element deflects said beam portion away from said plane so that said apex is about tangent therewith.

6. The connector according to claim 5 wherein said biasing element disengages from said second switch contact when said pin of said mating connector engages said contact end by further deflecting said beam portion away from said plane.

7. The connector according to claim 1 including a circuit element in a recess in said insulator in electrical contact with said contact device and said shell, said circuit element and said insulator being slidable together along said passage.

* * * * *